United States Patent [19]

Jones et al.

[11] 4,290,529

[45] Sep. 22, 1981

[54] RACK FOR BOAT FENDERS

[75] Inventors: John H. Jones, 7540-155 Bay Island Dr., South, South Pasadena, Fla. 33707; Lloyd P. Dewey, Canfield, Ohio

[73] Assignee: John H. Jones, South Pasadena, Fla.

[21] Appl. No.: 972,943

[22] Filed: Dec. 26, 1978

[51] Int. Cl.[3] ..... A47F 7/00

[52] U.S. Cl. ..... 211/13; 211/71; 248/219.4; 248/311.2

[58] Field of Search ..... 211/13, 71, 107, 112, 211/106; 9/1.7; 114/218; 248/311.2, 311.3, 309 R, 219.4, 218.4, 219.1

[56] References Cited

U.S. PATENT DOCUMENTS

| | | | |
|---|---|---|---|
| 1,053,103 | 2/1913 | Martus | 248/311.2 |
| 2,279,442 | 4/1942 | Burns et al. | 248/311.2 |
| 2,294,151 | 8/1942 | Wooten et al. | 248/311.2 X |
| 3,167,287 | 1/1965 | Collins | 248/311.2 X |
| 3,530,996 | 9/1970 | Schaffer | 248/311.2 X |
| 3,650,236 | 3/1972 | McFarlane | 114/218 |
| 4,011,951 | 3/1977 | Boyer | 248/311.2 X |

*Primary Examiner*—Roy D. Frazier
*Assistant Examiner*—Robert W. Gibson, Jr.
*Attorney, Agent, or Firm*—Marvin W. Murray

[57] ABSTRACT

A rack for boat fenders of the type having a cylindrical body from each end of which extends a rectangular protuberance that defines a line attaching eye. The rack is formed of elongate members so as to be of open construction and includes upper and lower elongate rigid members that are bent to form aligned openings sized to receive and support a fender in vertical orientation. Extending beneath the lower opening is a member which is offset from the center line of the opening so as to support the body of the fender but to permit the eye-forming protuberance to extend therebelow. Means for removably attaching the fender racks to a ship rail or like so that the position of the racks can be conveniently established at a location to afford convenient access to the fenders.

3 Claims, 6 Drawing Figures

RACK FOR BOAT FENDERS

BACKGROUND OF THE INVENTION

1. Field of the Invention

This invention relates to a rack for small boat fenders and more particularly to such rack which can be readily installed and removed and supports the fenders in a uniform orientation.

2. Description of the Prior Art

U.S. Pat. No. 3,650,236 discloses a marine line holder through which a fender attaching line extends. The holder supports the fender solely through the line whereby the fender can swing about when not in use.

U.S. Pat. No. 4,014,056 discloses a tank mounting means supported on the deck or rail of a marine vessel.

Typically small boat fenders, when not in use, are stowed in a compartment which may be conveniently accessible to the side rails of the vessel or may be below decks. Typically, the fenders are placed in a compartment in a disorganized manner whereby the lines associated with the fenders can become tangled and render difficult rapid access to the fender.

SUMMARY OF THE INVENTION

A rack according to the present invention is constituted by an open framework formed by an upper elongate member bent to form one or more openings, a lower elongate member bent to form openings in registry with the upper openings, a U-shaped member having a horizontal leg that is disposed beneath the lower elongate member and a clamp for attaching the framework to a vertical ship rail.

An object of the invention is to provide a fender rack which can be placed at or near a location of expected use so that the fender supported therein is readily available. This object is achieved because the rack embodying the present invention has clamping means which permit the rack to be attached at any desired location and to be conveniently moved from location to location if such is desirable.

A feature and advantage of a rack having the clamping means referred to above is that the rack can be clamped to the outboard ship rail, a location from which fenders are typically placed.

Another object of the invention is to provide a fender rack which permits the fenders stored therein rapidly to dry. This object is achieved according to the present invention because the rack is made in the form of an open framework which is free of depressions that collect water and which affords air circulation around the fenders.

A further object of the invention is to provide a fender rack wherein the fenders are stored in a specific uniform orientation. Accomplishment of this object in addition to affording a shipshape look to the fenders and rack also positions the rack in a consistent position so that the users thereof can quickly deploy the fenders without undue attention. This object is achieved by disposing the above mentioned horizontal leg at a precise offset location with respect to the center of the fender supporting openings. Because typical fenders have an eye defining protuberance that is rectangular in cross section, proper positioning of the horizontal leg assures that in one specific orientation the body of the fender will rest on the horizontal leg whereas in any other orientation the end of the protuberance will be supported on the leg thus to provide a visual indication that the fender is not properly in placed in the rack.

The foregoing, together with other objects, features and advantages will be more apparent from the following specification and the accompanying drawings.

DESCRIPTION OF THE PREFERRED EMBODIMENTS

Figure 1:
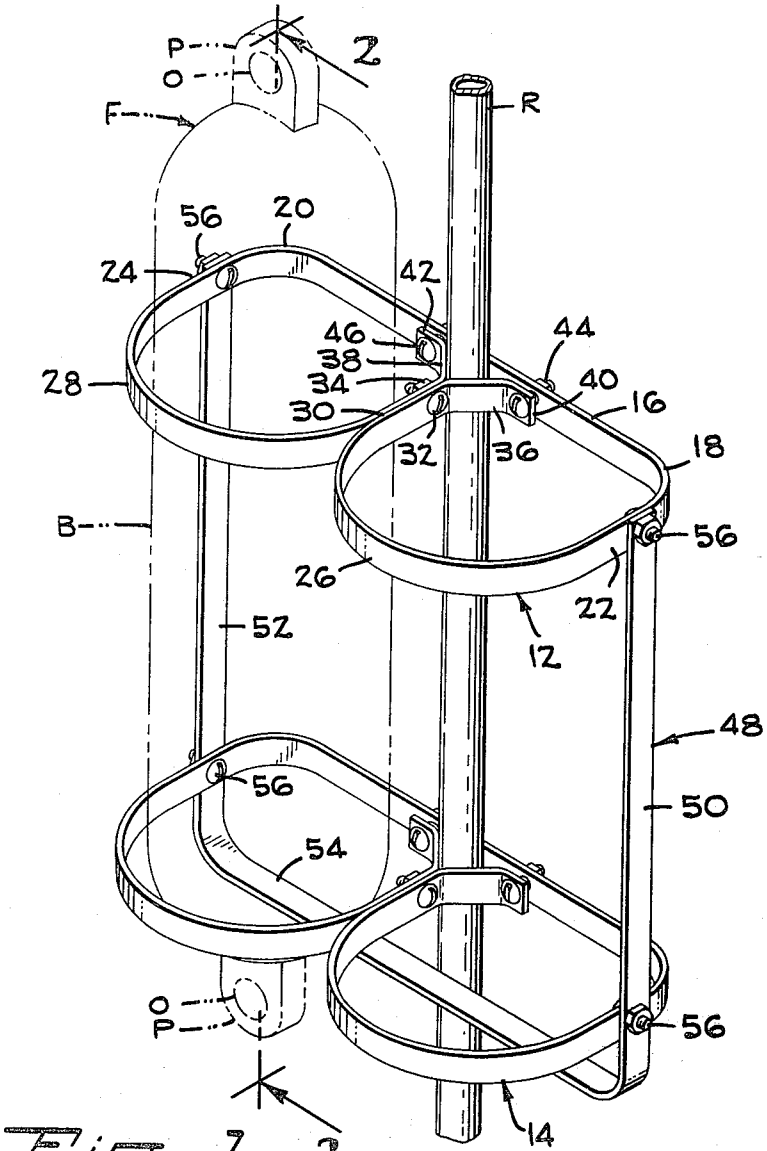
FIG. 1 is a perspective view of an embodiment of the invention configured for the storage of a pair of boat fenders.
Figure 2:
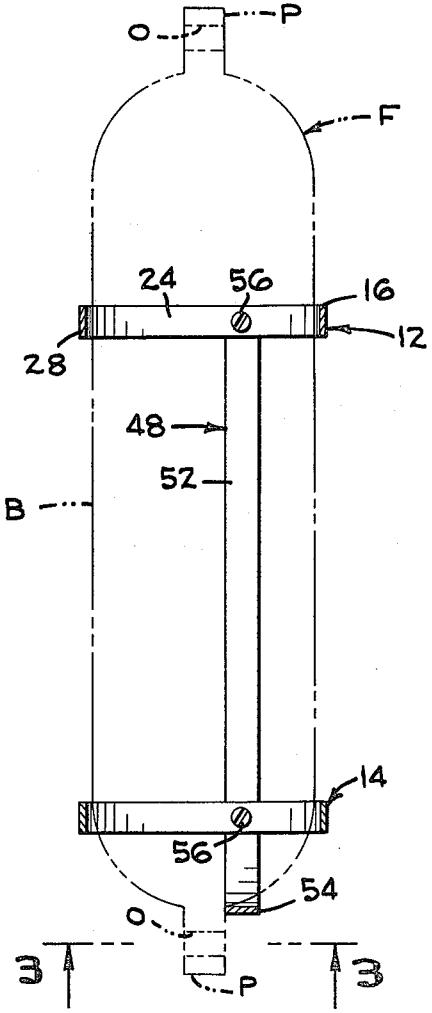
FIG. 2 is a cross section taken on lone 2—2 of FIG. 1.
Figure 3:
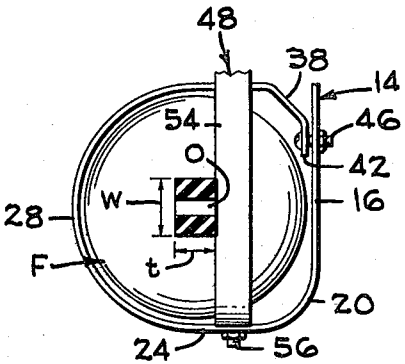
FIG. 3 is a cross section taken on line 3—3 of FIG. 2.

Referring more particularly to the drawings, an embodiment of the invention configured for the storage of a pair of boat fenders is shown in FIGS. 1–3, comprising of an upper elongate member 12 and a similar lower elongate member 14. The elongate members are bent to form identical congruent openings which are shaped to receive the fenders therein. Because the upper and lower members are substantially identical a description of one will suffice for description of both.

Elongate member 12 is formed of material having a rectangular cross section, 18 gauge chrome plated steel having a width of about ¾ inch exemplifying a suitable material. The member includes a linear rear portion 16 which has a length slightly less than two fender diameters. At opposite ends of linear portion 16 the elongate member is bent on a radius of curvature less than the radius of the fender to form arcuate portions 18 and 20. Extending forward from the respective arcuate portions are lateral flat portions 22 and 24 which are perpendicular to linear portion 16 and are spaced from one another by a distance approximately equal to two fender diameters. At the forward ends of lateral flat portions 22 and 24 are respective semicircular portions 26 and 28 which have a radius of curvature corresponding to that of the fender and which meet in the center at a tangency point 30. At tangency point 30 semicircular portions 26 and 28 are attached to one another by means of a connection which includes a screw 32 and a nut 34 which is threadedly engagable with the screw. Extending rearward from tangency point 30 are oblique portions 36 and 38. The oblique portions extend toward linear rear portion 16 and at their distal ends form flanges 40 and 42 which parallelly confront the linear rear portion. Threaded fasteners 44 and 46 are provided for removably attaching the confronting flanges to the rear linear portion 16. It will be noted that the threaded fasteners are located symmetrically of the midpoint of linear portion 16 so that the space bounded by the center region of the linear portion and oblique portions 36 and 38 is in the shape of an isosceles triangle.

Members 12 and 14 are fastened together by a U-shaped member 48 which has right and left vertical legs 50 and 52 and a horizontal leg 54 which extends between the lower ends of the vertical legs and is perpendicular thereto. Threaded fasteners 56 join the U-shaped member to the lateral flat portions of members 12 and 14.

U-shaped member 48 is offset from the central axis of the openings defined by members 12 and 14. As can be seen in FIGS. 2 and 3, fender F includes a cylindric body B from each longitudinal end of which extends an integral protuberance P. As can be seen in FIG. 3, protuberance P is symmetrical of the longitudinal axis of cylindric body B. Protuberance P has a thickness dimension t and width dimension w which is greater than the thickness dimension. The protuberance defines a line receiving opening O which extends through the thickness dimension of the protuberance.

U-shaped member 48 is mounted so that horizontal leg 54 is positioned so as to permit protuberance P to pass below the horizontal leg only if the protuberance is oriented as shown in FIGS. 2 and 3, with the width dimension parallel to the horizontal leg and the thickness dimension perpendicular to the horizontal leg. If the fender is placed in the rack in any other position the axial extremity of protuberance P will abut the upper surface of horizontal leg 54, which prevents downward movement of fender F to the position shown in FIG. 2. Not only does this positioning of the U-shaped member facilitate neatness and uniformity in stowing the fenders, but it assures positioning of the fenders in a uniform way so that crew members can quickly and accurately deploy the fenders when they are needed.

The embodiment of the invention shown in FIGS. 1–3 can be shipped substantially flat by loosening threaded fasteners 56 so that upper and lower members 12 and 14 can be folded into substantial coplanar relationship with U-shaped member 48. When it is desired to install the rack on a vertical ship rail, such as indicated at R in FIG. 1, screw 32 is removed from tangency point 30 so that the rack can be installed onto the rail within the triangular space defined by linear portion 16 and oblique portions 36 and 38. Bolt 32 is then replaced and engaged with nut 34 and bolts 44 and 46 are tightened until firm frictional engagement with rail R is achieved.

Figure 4:
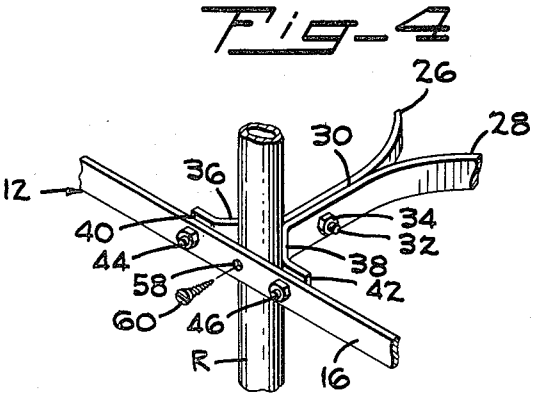
FIG. 4 is a fragmentary perspective view showing a modification.

In those cases where the diameter of vertical ship rail R is extremely small, the modification shown in FIG. 4 can be employed. In such modification linear portion 16 is formed with a screw hole 58 located midway between the location of screws 44 and 46. A small hole can be drilled in rail R so as to receive a self-tapping sheet metal screw 60, thus firmly but removably retaining the fender rack onto the ship rail.

In addition to mounting the rack shown in FIG. 1 to a ship rail, mounting on a bulkhead or the like is conveniently achieved by removing screws 44 and 46 and replacing them with wood screws that enter the bulkhead. Thus the rack can be installed at virtually any location at which it is likely that fenders will be needed. At all locations the fenders are neatly and securely retained in a position ready for use.

Figure 5:
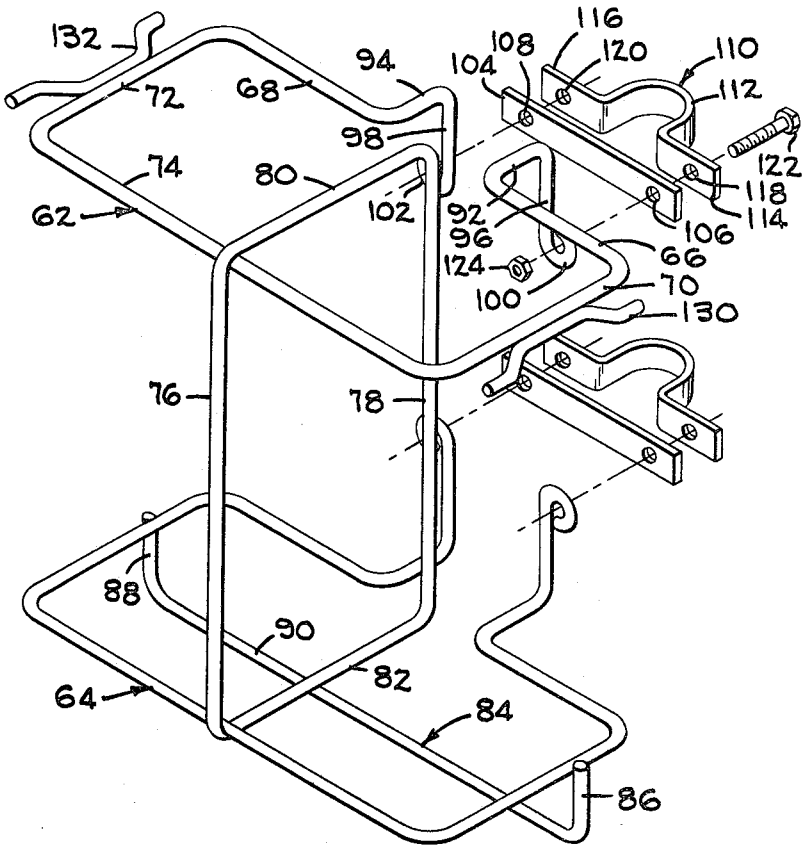
FIG. 5 is an exploded perspective view of another embodiment of the invention.

The embodiment of the invention shown in FIG. 5 is similar in many respects to that shown in FIG. 1, the principal difference being that the rack is formed with steel rod having a circular cross section. An exemplary rod that is suitable for fabricating the rack shown in FIG. 5 is No. 302 stainless steel rod having a diameter of about 5/32 inch. The rack of FIG. 5 includes upper and lower elongate members 62 and 64 which are identical to one another and are bent to form identical congruent openings that are shaped to receive fenders therein. Upper elongate member 62, which is exemplary of the lower elongate member, is of generally rectangular form having coaxial linear portions 66 and 68 which form a linear rear portion, lateral linear portions 70 and 72 which are parallel to one another and perpendicular to the rear linear portions and front linear portion 74 which is parallel to rear linear portions 66 and 68 and spaced therefrom by an amount corresponding to the diameter of the fender.

Upper and lower elongate members 62 and 64 are fastened together in operative relationship by a front vertical leg 76 of a rectangular member. The rectangular member includes a rear vertical leg 78 and upper and lower horizontal legs 80 and 82. The horizontal legs divide the rectangular openings defined by elongate members 62 and 64 into two substantially identical generally square openings having dimensions which correspond to the diameter of fender F. Extending below lower elongate member 64 is a U-shaped member 84 which has vertical legs 86 and 88 secured to opposite lateral edges of elongate member 64 and a horizontal leg 90 extending between the vertical legs. Horizontal leg 90 is positioned with respect to protuberance P on the fenders as has been described hereinabove in connection with horizontal leg 54 of the embodiment in FIGS. 1–3 so as to facilitate uniform positioning of the fenders in the rack.

For effecting attachment of the rack to a vertical ship rail, elongate member 62 includes rearward portions 92 and 94 which extend rearward from linear portions 66 and 68. From the rear extremities of the respective rearward portions vertical mounting legs 96 and 98 extend. At the vertical extremities of the vertical legs the elongate member is bent to form screw loops 100 and 102.

A flat clamping plate 104 is provided with holes 106 and 108 which are spaced apart so as to register with screw loops 100 and 102. A clamping member 110 has an arcuate portion 112 from opposite sides of which extend tabs 114 and 116. The tabs form respective holes 118 and 120 which are spaced apart so as to register with holes 106 and 108 and screw loops 100 and 102. Screws 122 and nuts 124 are provided for extending through the above described holes and loops so as to effect installation of the rack onto a vertical ship rail member.

As can be seen in FIG. 5 vertical legs 96 and 98 of upper elongate member 62 extend downward whereas the vertical legs of lower elongate member 64 extend upward. Not only does this contribute to the neat appearance of the device but permits installation of the device on shorter vertical rail sections. In addition the inward extension of the vertical legs makes it possible to install the rack with upper elongate member 62 projecting above the horizontal ship rail thus positioning the rack and the fenders supported therein for more rapid access.

Cleats 130 and 132 are mounted to respective lateral members 70 and 72 so that the line connected through the opening O in protuberance P of the fender can be secured to the rack. This permits the fender to be secured at a proper height in a quick convenient way and without the necessity for formation of time consuming knots around other portions of the rail.

Use and installation of the embodiment of FIG. 5 is substantially similar to that described hereinabove except that the device of FIG. 5, since it is of welded construction, cannot be folded flat for shipping. In order to install the rack to a ship rail, it is necessary only to position clamp bar 104 and strap 110 on opposite sides of a vertical ship rail and to pass screws 122 through the registered openings and engage nut 124 therewith.

Figure 6:
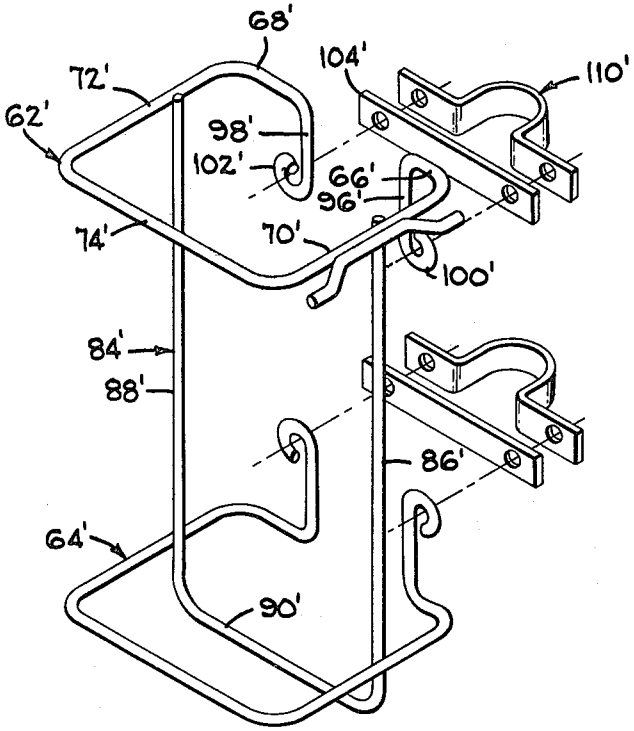
FIG. 6 is an exploded perspective view of a further embodiment of the invention configured for the storage of one boat fender.

FIG. 6 discloses yet another embodiment of the invention, configured for the storage of a single boat fender. Because of the similarities of construction between the embodiment of FIG. 6 and FIG. 5, reference numerals employed in FIG. 6 correspond to similar reference numerals in FIG. 5 with the addition, however, of a prime (′). Thus the rack of FIG. 6 has an upper elongate member 62′ and lower elongate member 64′. The elongate members are bent to form a generally square opening and include rear coaxial segments 66′ and 69′, lateral segments 70′ and 72′ and a front segment 74′. A U-shaped member 84′ has vertical legs 86′ and 88′ and a horizontal leg 90′. The lateral edges of elongate members 62′ and 64′ are welded to vertical members 86′ and 88′ to support upper and lower members in vertically spaced apart aligned orientation. The U-shaped member is mounted so that horizontal leg 90′ is positioned to cooperate with protuberance P such as to orient the fender as has been described above.

The rear portion of the elongate members have vertically extending legs 96′ and 98′ which on their extremities form respective bolt loops 100′ and 102′. A clamp plate 104′ and a strap 110′ have screw holes for registry with the screw loops 100′ and 102′ so as to afford mounting of the device as described hereinabove in connection with FIG. 5.

Thus it will be seen that the present invention provides a fender rack which affords numerous salutary advantages. The fenders can be stored in the rack while wet, and because of the rack's open construction, air circulation for drying the fenders is permitted. Because of the location of the lower horizontal member in each embodiment of the invention, the rack can be conveniently installed on existing vessels without modifying or adversely affecting the vessel in any way. Finally, the mounting means constituting a part of the invention permits the rack to be installed at its most convenient place on a vessel to the end that the fenders are readily accessible when needed but are securely and neatly stored between uses.

While several embodiments have been shown and described, configured for the storage of one or two boat fenders, it is to be understood that a rack may be constructed for other numbers of fenders in accordance with the principles of the present invention. These and other adaptations and modifications can be made without departing from the true spirit and scope of the invention, as set forth in the claims.

What is claimed is:

1. A rack for a boat fender of the type having an elongate cylindric body from at least one end of which extends a protuberance that defines a line attaching opening and has a thickness dimension, a width dimension greater than the thickness dimension and an opening extending through the thickness of the protuberance, the fender rack comprising an open framework formed by a plurality of elongate rigid members including upper and lower members bent to define first upper and lower congruent openings shaped to snugly receive the fender therein, means for supporting said members in vertically aligned spaced apart relation and a U-shaped member having spaced apart vertical legs joined to at least said lower member and a horizontal member extending between said vertical legs below said lower member, said U-shaped member being offset from the center of the openings formed by said upper and lower members so that when the width dimension of said eye-forming protuberance is parallel to the horizontal leg the body of said fender is supported on said horizontal leg and so that when the fender is positioned so that the width dimension is oblique of the horizontal leg the eye-forming protuberance is supported on the horizontal leg, said rack also including upper and lower straps, each said strap having an arcuate portion adapted to circumscribe the vertical ship rail member and first and second tabs integral with and extending outward of the respective ends of said arcuate portion, said tabs being substantially coplanar with one another and defining tab holes therein, said upper and lower members forming fastener openings in registry with said tab holes, and threaded fasteners extendable through said fastener openings and said tab holes for retaining said straps in circumscribing relation to the vertical ship rail and for retaining said framework to said straps.

2. A rack according to claim 1 wherein said upper and lower members define second upper and lower openings laterally adjacent respective said first openings, said second openings being retained in vertically aligned spaced apart relation by said supporting means, said horizontal leg of said U-shaped member extending below said second lower member to support a second fender adjacent said first fender.

3. A rack according to claim 1 wherein said upper and lower members are of circular cross-section.

* * * * *